United States Patent [19]

Matsuoka et al.

[11] Patent Number: 4,666,570

[45] Date of Patent: May 19, 1987

[54] PROCESS FOR PRODUCING AROMATIC COMPOUND WITH FUNCTIONAL GROUPS

[75] Inventors: Yuuji Matsuoka; Kazunori Yamataka; Atsushi Shimizu, all of Nobeoka, Japan

[73] Assignee: Asahi Kasei Kogyo Kabushiki Kaisha, Osaka, Japan

[21] Appl. No.: 791,121

[22] Filed: Oct. 24, 1985

[30] Foreign Application Priority Data

| | | | |
|---|---|---|---|
| Oct. 30, 1984 | [JP] | Japan | 59-226672 |
| Dec. 13, 1984 | [JP] | Japan | 59-261751 |
| May 9, 1985 | [JP] | Japan | 60-96684 |
| May 15, 1985 | [JP] | Japan | 60-101586 |
| May 20, 1985 | [JP] | Japan | 60-106126 |

[51] Int. Cl.[4] ..... C25B 3/02

[52] U.S. Cl. ..... 204/59 R; 204/72; 204/78; 204/81

[58] Field of Search ..... 204/81, 72, 78, 59 R

[56] References Cited

U.S. PATENT DOCUMENTS

| | | | |
|---|---|---|---|
| 3,386,899 | 4/1968 | Shepard et al. | 204/81 |
| 3,975,439 | 8/1976 | Klabunde | 260/581 |
| 4,544,450 | 10/1985 | Oberrauch et al. | 204/59 R |

FOREIGN PATENT DOCUMENTS

| | | | |
|---|---|---|---|
| 56-133480 | 10/1981 | Japan . | |
| 1026187 | 10/1964 | United Kingdom | 204/81 |
| 1021908 | 3/1966 | United Kingdom | 204/59 R |

*Primary Examiner*—Arthur P. Demers

*Attorney, Agent, or Firm*—Birch, Stewart, Kolasch & Birch

[57] ABSTRACT

An aromatic compound with functional groups is produced by carrying out electrolytic oxidation of an iodide in an electrolyte containing an inorganic weak acid salt and/or medium acid salt, allowing the electrolyzed product to react with an aromatic compound having an electron donating group with a Hammet's substituent constant ($\sigma$p-) of $-0.25$ or lower and allowing the resultant iodized aromatic compound to react with a nucleophilic reagent.

15 Claims, 1 Drawing Figure

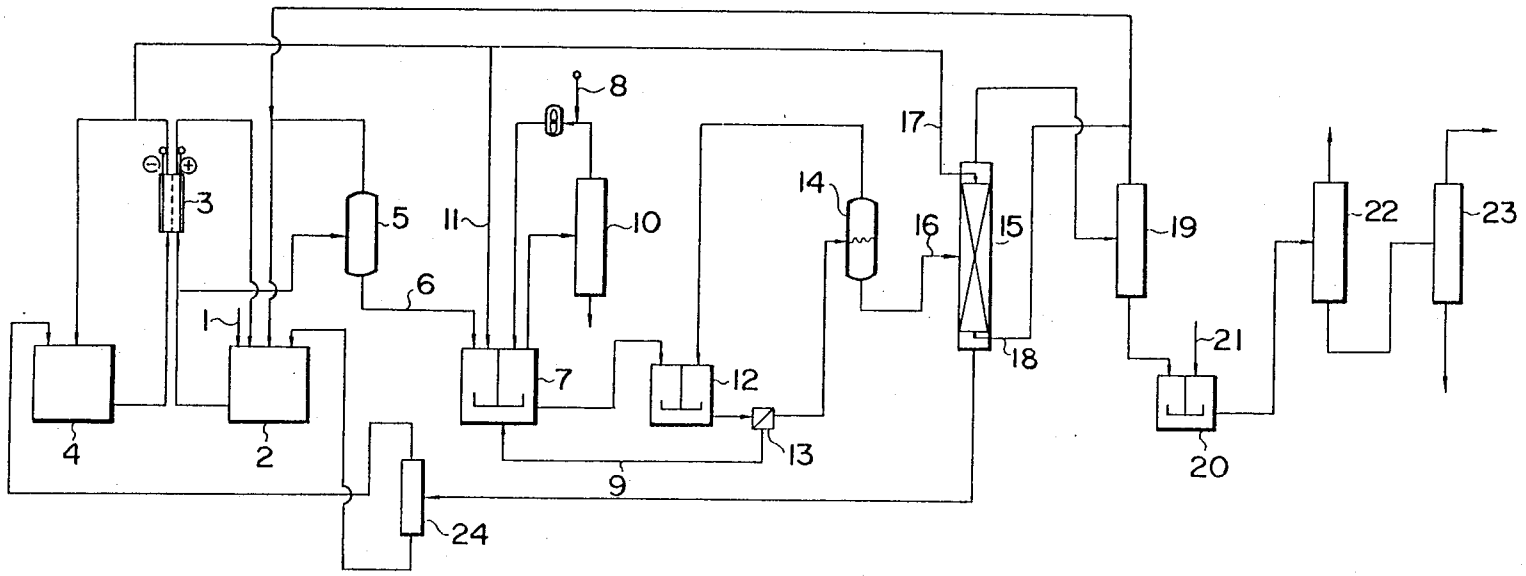
23
22
21
20
19
18
15
17
16
14
13
12
10
8
9
7
11
6
5
24
2
1
3
4

PROCESS FOR PRODUCING AROMATIC COMPOUND WITH FUNCTIONAL GROUPS

BACKGROUND OF THE INVENTION

This invention relates to a process for producing a nucleophile-substituted aromatic compound by iodizing an aromatic compound having an electron donating group by electrolytic oxidation reaction to obtain an iodized aromatic compound, and then allowing the iodized aromatic compound to react with a nucleophilic reagent. Particularly, the present invention pertains to a process which comprises obtaining p-iodoaniline (hereinafter abbreviated as PIA) from aniline (hereinafter abbreviated as AN) and then producing p-phenylenediamine (hereinafter abbreviated as PPD) therefrom.

PPD is useful as a synthetic intermediate for dyes, pigments, pharmaceuticals, monomers of aramide fibers, polyimide resins, etc.

A process for producing an aromatic compound by iodizing an aromatic compound with functional groups having an electron donating group by electrolytic oxidation reaction and then allowing the iodized aromatic compound to react with a nucleophilic reagent is disclosed in U.S. Pat. No. 3,975,439. In this patent it is disclosed that AN is iodized by an electrolytic oxidation reaction to obtain PIA, which is then allowed to react with ammonia. According to this process, PIA is obtained by electrolytic oxidation reaction by a diaphragm process, is allowed to react with ammonia and thereafter the ammonia iodide produced as a by-product is allowed to react with sodium hydroxide to recover ammonia and sodium iodide, the sodium iodide recovered being returned to the electrolytic system, to produce PPD.

When electrolytic reaction is carried out following the technique of the prior art, in the case of using a diaphragm, hydrogen iodide will be formed during the electrolytic reaction, whereby the electrolyte abruptly becomes acidic. The anolyte, which is initially a two-layer system of oil and water, will become a homogeneous system with the progress of electrolysis. Although there is no description of this, as a means for ensuring separation of the anolyte by the decanter, there is a description about maintaining the pH within the range of from 5 to 8 by addition of an aqueous sodium hydroxide solution.

However, as shown in the Comparative Examples of this application, when electrolytic reaction is carried out while adding an aqueous sodium hydroxide solution, it has been found that not only maintenance of pH within the range of from 5 to 8 is very difficult, but also the voltage will also change considerably, whereby it is very difficult to stably carry out the electrolytic reaction. Further, by-products such as azobenzene, 4-aminodiphenylamine, etc. are formed, although small in amounts. It is also observed that the oil layer has migrated through the diaphragm (in this case, Nafion membrane is used). On the other hand, also in using no diaphragm, current efficiency will be lowered to a great extent, and the by-products of azobenzene and 4-aminodiphenylamine are formed in large amounts.

SUMMARY OF THE INVENTION

The present inventors have made intensive studies to overcome the drawbacks possessed by the process of the prior art and have developed a technique which can stand industrialization and consequently have surprisingly found that by addition of an inorganic weak acid salt and/or medium acid salt, particularly a phosphoric acid salt, into the electrolyte, PIA can be obtained at high current efficiency and with production of the by-products being suppressed to a low level, and yet the electrolytic reaction can be stably carried out. Further, by limiting the pH in the aqueous phase of the electrolyte within a specific range, a further improved effect can be obtained. This process is applicable not only to production of PPD in the prior art technique, but also to an aromatic compound having a specific electron donating compound. Also, the iodine generated by the electrolytic oxidation reaction can be taken out of the electrolytic system and allowed to react with an aromatic compound with functional groups having an electron donating group, and therefore the present invention is also useful with an aromatic compound which is unstable in an electrolytic system.

The present invention is based on the above findings and is a process for producing an aromatic compound, comprising the steps of:

oxidizing an iodide compound by electrolytic oxidation in an electrolyte comprising an inorganic weak acid salt and/or medium acid salt to form an electrolyzed product; reacting the electrolyzed product with an aromatic compound having an electron donating group with a Hammet's substituent constant ($\sigma$p-) of $-0.25$ or lower to produce an iodized aromatic compound substituted with said electron donating group; and reacting the iodized aromatic compound with a nucleophilic reagent to form said nucleophile-substituted aromatic compound.

BRIEF DESCRIPTION OF THE DRAWING

The sole FIGURE of the drawing is a flow sheet showing an embodiment of the present invention.

DESCRIPTION OF PREFERRED EMBODIMENTS

In the present invention, an inorganic weak acid salt and/or medium acid salt is added into the electrolyte, whereby the electrolytic reaction can be carried out very stably. That is, the pH change in the aqueous phase of the electrolyte is very moderate and the pH can be easily controlled. Also, an aromatic monoamine or an iodized aromatic amino compound will be dissociated to a small extent, and therefore migration of these compounds through ionization by passing through the diaphragm toward the cathode side or side reactions will scarcely occur. Also, the voltage change is very small and the voltage will be lowered.

As the inorganic weak acid salt or medium acid salt to be used in the present invention, there may be included phosphoric acid salts, boric acid salts or mixed salts thereof, but phosphoric acids are generally preferred. As the phosphoric acid salts to be employed, ammonium phosphate, sodium phosphate and potassium phosphate are preferred. Industrially, sodium phosphate is more preferable. The phosphoric acid salt concentration in the aqueous layer should preferably be 1 to 20% by weight because the viscosity of the aqueous layer will become high if it is in excess of 20% by weight.

The aromatic compound having an electron donating group to be used in the present invention should preferably have a Hammet's substituent constant ($\sigma$p-); of −0.25 or lower. An aromatic compound having an electron donating group having a Hammet's substituent constant greater than −0.25 will be very low in current efficiency or undergo no reaction. Suitable aromatic compounds may include, for example, aromatic compounds having amino, N-alkylamino, N,N-dialkylamino, hydroxy or alkoxy group. Particularly, it is preferable to use aromatic amino compounds such as aniline, N-methylaniline, N,N-dimethylaniline, o-toluidine, m-toluidine, N-methyl-o-toluidine, N,N-dimethyl-o-toluidine, N-methyl-m-toluidine, N,N-dimethyl-m-toluidine and the like, phenol or phenol derivatives such as anisole, o-cresol, m-cresol, 2,3-xylenol, 2,4-xylenol and the like.

In the present invention, it has also been determined that the pH of the aqueous layer in the electrolyte has a very great influence on the electrolytic reaction. As is clear from Examples and Comparative examples, it has been determined that high current efficiency can be obtained only within a specific range of pH and substantially no by-product will be formed. More specifically, in the case of an aromatic amino compound, the pH range of the aqueous layer should preferably be within the range of from 5.5 to 6.9. Under alkalilne conditions over pH 6.9, the current efficiency will be lowered markedly, whereby production of by-products such as of azobenzene type or 4- aminodiphenylamine type by-products will be considerably increased. This phenomenon will markedly appear in the case of the electrolytic method which does not use a disphragm because the aqueous phase will become alkaline. At a pH lower than 5.5, formation of an aromatic amino compound or an iodized aromatic amino compound will be increased, whereby the migration of these compounds through the membrane toward the cathode side will be increased in the case of the diaphragm electrolytic method. Also, electrolytic reaction can hardly be carried out normally.

On the other hand, in the case of a phenol derivative, it is preferred to maintain the pH of the aqueous layer within the range of from 6.5 to 10.0 from the viewpoint of maximizing yield.

In the present invention, these aromatic compounds having electron donating groups can be fed into the reaction system, before the electrolytic oxidation reaction, in the course of the electrolytic oxidation reaction or after the electrolytic oxidation reaction. Also, it is possible to combine these feeding methods in any desired manner. In any case, an iodized aromatic compound can be obtained. Thus, in the present invention, the timing for feeding an aromatic compound having an electron donating compound can freely be selected.

In the present invention, when a phenol derivative is used, the phenol derivative should preferably be fed after the iodine-generating electrolytic reaction This is because a phenol derivative existing in the electrolytic oxidation reaction system will be oxidized to result in increase of by products.

In the present invention, the iodide compound refers to one which is soluble in water and an electrolyte. The iodide may include ammonium iodide, iodides of alkali metals, quaternary ammonium iodide, preferably ammonium iodide, sodium iodide, and potassium iodide. Industrially, sodium iodide is particularly preferred. The cation may preferably be the same cation as in the cation of the above-mentioned phosphoric acid salt.

Electrolytic reaction of the iodide compound may be performed without any trouble according to either the diaphragm process or the process which does not use a diaphragm. In the case of the diaphragm process, hydrogen iodide will be generated at the anode and the corresponding hydroxide at the cathode. When a hydroxide is necessary, the diaphragm process is selected. On the other hand, in the case of the process which does not use a diaphragm, the aqueous layer will become alkaline due to the hydroxide generated at the cathode, whereby the risk of lowered current efficiency is very high, but, according to the present invention, as apparently seen from Example 3 and Comparative Example 3, the pH change is small and high current efficiency can be stably obtained. This process requires no diaphragm to afford a simple electrolytic cell structure and yet the interelectrode distance can be made narrow to improve power unit.

As the anode material, there may be employed platinum, ruthenium, rhodium or iridium either alone or plated with titanium or tantalum, alloys of the respective metals, plating of alloys or oxide alloys of platinum, ruthenium, rhodium, iridium and valve metal (titanium, tantalum, etc.), carbon, etc.

As the cathode material, it is preferred to use those with low hydrogen overvoltage, which are not particularly limited, but iron, nickel, stainless steel and titanium may be included.

When employing a diaphragm, a cation exchange membrane, an anion exchange membrane, etc. may be used, if necessary.

In the following, description is made about the diaphragm process. The description is mostly applicable for a process which does not use a diaphragm, and only Examples thereof are shown.

The electrolytic cell may be of a type conventionally used in organic electrolytic reaction which can pass an electrolyte between the electrodes. For example, an electrolytic cell may be constructed by having a cathode plate and an anode plate opposed in parallel to each other and placing a polyethylene plate, a diaphragm for defining the membrane-electrode distances in this order so as to form the cathode chamber and the anode chamber between the both electrodes. At the central portions of these polyethylene plates, openings for permitting the electrolyte to pass therethrough are provided. The current passage areas of the electrodes are determined by the sizes of the openings, and the distance between each electrode and the diaphragm is defined by the thickness of the polyethylene plate. Anolyte and catholyte are supplied respectively into the anode chamber and the cathode chamber through feeding inlets provided at the electrolytic cell from respective tanks and are discharged from outlets, while undergoing partially when passing through the chambers, to be returned to the anolyte tank and the catholyte tank, respectively, thus being circulated between the tanks and the chambers.

The current density may preferably be 1 to 30 $A/dm^2$, because the voltage will become markedly higher at a current density higher than 30 $A/dm^2$, while productivity will be lowered at a current density lower than 1 $A/dm^2$.

The electrolytic temperature may preferably be 20° to 80° C. At a temperature lower than 20° C., the voltage will be increased to worsen power unit, and a temperature over 80° C. will make it impossible to practice electrolysis for the reason of the materials employed for the electrolytic cell.

The flow velocity of the electrolyte through the electrolytic cell may preferably be 0.1 to 4 m/sec. At a velocity slower than 0.1 m/sec., the current efficiency will be lowered, while at a velocity more rapid than 4 m/sec., the pressure loss within the electrolytic cell will be increased very much.

The distance between each electrode and the diaphragm is preferably 0.5 to 3 mm.

The pH of the aqueous phase can be controlled by adding corresponding hydroxide, hydrogen iodide or phosphoric acid, if necessary.

In the present invention, the iodized aromatic compound is subsequently allowed to react with a nucleophilic reagent to produce the corresponding aromatic compound.

As the nucleophilic reagent, there may be included ammonia, aminophenol, a cyano compound, a hydroxyl compound, a fluoro compound, etc.

Now, production of the corresponding aromatic amino compound by amination of an iodized aromatic compound with ammonia is described in detail by referring to an example wherein the iodized aromatic compound is PIA and the aromatic amino compound is PPD.

The amination reaction is carried out by adding a catalyst and ammonia into the oily layer containing PIA produced in the electrolytic reaction. The oily layer obtained in the electrolytic reaction contains AN, which is the starting material, PIA, which is the product and water corresponding to its solubility, and the amination reaction is carried out basically not in a non-aqueous system but in the presence of water. Ammonia is added in an amount of 10 to 50-fold mol, preferably 20 to 30-fold mol, relative to the molar concentration of the iodized aromatic compound. The water concentration in ammonia may be less than 50 % by weight and cause no problem, preferably less than 20 % from the viewpoint of reducing by-products. The amination reaction temperature, which depends on the kind and the amount of the catalyst employed, may be room temperature to permit the reaction to proceed, but preferably 50° C. or higher from the viewpoint of the reaction rate, preferably 150° C. or lower from the viewpoint of the reaction pressure. It is also preferable in the amination reaction to have the iodized aromatic compound completely reacted, and for this purpose the reaction temperature should preferably be 70° C. or higher.

The catalyst to be used for the amination reaction may preferably be a cuprous compound. More preferably, a cuprous iodide with the same anion should be used. With the use of a cupric compound, the reaction rate will be slower. The catalyst may be used in an amount of 0.5 to 50 mol % based on the iodized aromatic amino compound, but preferably in an amount of 2 to 20 mol % from the viewpoint of reaction rate.

The reaction mixture after completion of the amination reaction is a mixture containing AN, PPD which is the product, ammonium iodide, the catalyst, excessive ammonia and water. For separation of PPD from the reaction mixture, it is necessary to separate and recover first excessive ammonia, subsequently the catalyst, then ammonium iodide, and thereafter the aromatic diamine.

For recovery of the copper catalyst from the aminated reaction mixture, after removal of excessive ammonia, ammonium ions (existing as ammonium iodide) are removed by addition of the alkali hydroxide. By products, formed in the case of producing the iodized aromatic compound by the diaphragm electrolysis process, are preferably removed by addition of water to separate the mixture into two layers, followed by removal of the aqueous layer by water extraction, etc. In the case of production by a process which does not use a diaphragm ethers ad alkali hydroxide are permitted to exist at the same time. Unless ammonia is removed, the copper catalyst cannot be completely recovered, and unless the alkali hydroxide and ethers are added at the same time, the copper catalyst cannot be completely recovered.

The ethers may preferably be aliphatic ethers having 6 to 8 carbon atoms. More preferably, commercially readily available dibutyl ether and diisopropyl ether are preferred. With carbon atoms of 5 or less, separation of the copper catalyst is inefficient, while with carbon atoms of 9 or more, the boiling point is so high that distillation separation can be done only with difficulty. The amount of ethers to be added may preferably be 0.5 to 5-fold of AN contained in the aminated reaction mixture. At a level less than 0.5-fold, the copper catalyst can be separated insufficiently, while the amount of ethers to be circulated is too much at a level over 5-fold.

The alkali hydroxide may preferably be sodium hydroxide or potassium hydroxide. Particularly, in the case of the diaphragm process, the alkali hydroxide generated at the cathode can be used.

From an industrial point of view, the ammonium iodide by-product in the amination reaction should be recovered and circulated into the electrolyte, but it is also possible to circulate it as a mixture with iodides other than the iodide recovered. Ammonium iodide may be circulated after being converted to alkali iodide, if desired. As described above, when producing an iodized aromatic compound according to the diaphragm system electrolysis process, it is preferred to be converted to an alkali iodide.

Recover and separation of ammonium iodide may be performed by, for example, by adding an aqueous alkali hydroxide solution during separation of the catalyst and separating by extraction from the oil layer as the alkali iodide to the aqueous alkali hydroxide solution side or adding water after separation of the catalyst and separating by extraction from the oil layer as the aqueous solution of ammonium iodide.

On the other hand, PPD exists primarily in the oil layer containing AN which is the starting material, but it is also partitioned in a considerable amount in the aqueous layer containing the alkali iodide or ammonium iodide, and the aqueous layer should preferably be extracted with, for example, AN. Separation of PPD from the solution containing PPD thus obtained and AN is performed by distillation.

The aqueous solution of the alkali iodide or ammonium iodide recovered as described above (these are written comprehensively as the iodide) is circulated solely or after being mixed with other iodides into the electrolyte. In the aqueous solution circulated, the product aromatic diamine is generally mixed in not a little amount, although it may be separated by performing the above extraction treatment.

Another specific feature of the present invention resides in regulating the amount of PPD in the aqueous iodide solution circulated into the electrolyte. As also shown in Examples 4, 5, 6, 7 and Comparative Example 4, the electrolytic reaction is found to be worsened to a great extent when PPD is mixed into the electrolyte even in a small amount. That is, as the concentration of PPD in the electrolyte is increased, the current efficiency will become lowered to a great extent and, moreover, polymeric materials will stick onto the anode surface to causing an increase of the voltage. For prevention of such a phenomenon, it is necessary to thoroughly remove PPD in the aqueous iodide solution circulated into the electrolyte. In other words, it is preferable to remove PPD from the aqueous iodide solution circulated to a concentration maintained at 0.5 % by weight or lower. More preferably, the PPD concentration in the electrolyte should be maintained at 0.1 % by weight or lower. On the basis of the above knowledge, it is rendered possible to conduct the whole process including recovery and circulation of the iodide in an electrolytic system.

Next, the reaction between an iodized aromatic compound and aminophenol is described in detail by referring to an example of the process for producing diaminodiphenyl ether (hereinafter abbreviated as DADPE) by the coupling reaction between PIA and aminophenol.

As the solvent, there may be employed dimethyl sulfoxide, dimethylformamide, dimethylacetamide, aniline, tetrahydrofuran, benzene, toluene, etc., particularly preferably a polar solvent. These solvents may be used either singly or as a mixture of two or more solvents.

As the catalyst, copper and most copper compounds may be available, of which cuprous iodide, cuprous chloride, cuprous oxide, cuprous bromide, cuprous cyanide, copper sulfate, cupric chloride, cupric hydroxide, cupric oxide, cupric bromide, cupric phosphate, copper nitrate, copper carbonate, copper acetate and the like are preferred. These compounds may be used either singly or as a mixture of two or more compounds. The amount employed is not particularly limited, but preferably within the range of from 0.1 mol % to 50 mol % based on PIA.

As the alkali, sodium hydroxide, potassium hydroxide, an alcholate, sodium hydride, sodium amide, sodium, potassium, etc. may be used. When recovery of the alkali iodide by-product after the coupling reaction is considered, it is preferred to employ sodium hydroxide or potassium hydroxide. Thus, the alkali iodide recovered, after appropriate purification treatment, is circulated into the electrolysis step for PIA production. During this operation, the product DADPE, which will worsen the electrolytic reaction to a great extent similarly as the aminated product PPD, should be maintained at a concentration of 0.5 % by weight or lower in the electrolyte, preferably 0.1 % by weight or lower. Iodide anions will react oxidatively with aniline to form alkali hydroxide in the case of the diaphragm electrolytic process. The alkali hydroxide can be reused.

The coupling reaction may be carried out by charging at once PIA, aminophenol, the alkali, the catalyst and the solvent into a reactor, or alternatively, by forming the alcholate of aminophenol only from aminophenol, the alkali and the solvent, followed by addition of PIA and the catalyst to carry out the reaction. The reaction may be carried out at a temperature range of from room temperature to 200° C., and the reaction temperature can be selected from the relationship with the reaction time. Also, the reaction may preferably be conducted under a nitrogen or argon gas stream.

Next, the reaction between an iodized aromatic compound and cyanide ion is described in detail by referring to an example of the process for producing p-aminobenzonitrile (hereinafter abbreviated as PABN) by the reaction between PIA and a cyano compound.

The solvent to be employed may be ordinarily a polar solvent, including generally methanol, ethanol, ethylene glycol, ethyleneglycol monomethyl ether, acetonitrile, aniline, dimethylformamide, dimethylacetamide, dimethyl sulfoxide, etc., preferably a polar aprotic solvent. These solvents may be used either singly or as a mixture of two or more solvents.

The catalyst to be employed may most preferably be cuprous cyanide, or otherwise cuprous iodide, copper sulfate, cuprous oxide, cuprous bromide, cuprous chloride, cupric oxide, cupric bromide, cupric chloride, copper acetae, copper nitrate, etc., which may be used either singly or as a mixture of two or more compounds. The amount employed is not particularly limited, but preferably 0.1 to 50 mol % based on the reactant PIA.

As the cyano compound, sodium cyanide or potassium cyanide is generally employed, but hydrogen cyanide may also be available.

The reaction may be carried out at a temperature range of from 50° C. to 250° C. by charging PIA, the cyano compound, the catalyst and solvent into a reactor, and the reaction temperature may be selected from the relationship with the reaction time. Also, the reaction should preferably be conducted under a nitrogen atmosphere.

The iodide recovered by the reaction, after appropriate purification treatment, is circulated for reuse into the electrolysis step for production of PIA. During this operation, the product PABN, which will worsen the electrolytic reaction similarly as PPD in the amination reaction, should be maintained at a concentration in the electrolyte of 0.5 % by weight or less, preferably 0.1 % by weight or less.

Next, the reaction between an iodized aromatic compound and hydroxy ion is described in detail by referring to an example of the process for producing p-aminophenol by the reaction between PIA and a hydroxy compound.

The catalyst to be employed may most preferably be cuprous oxide, or otherwise cuprous iodide, copper sulfate, cuprous bromide, cuprous chloride, cupric oxide, cupric bromide, cupric chloride, copper acetate, copper nitrate, etc., which may be used either singly or as a mixture of two or more compounds. The amount employed is not particularly limited, but preferably 0.1 to 50 mol % based on the reactant PIA.

As the hydroxy compound, sodium hydroxide or potassium hydroxide may preferably be used also from the viewpoint of recovery of the alkali iodide by-product after the reaction. That is, the iodide recovered, after appropriate purification treatment, is circulated for reuse into the electrolysis step for production of PIA. During this operation, the product p-aminophenol, the entrainment of which will worsen the electrolytic reaction, should be maintained at a concentration in the electrolyte of 0.5 % by weight or less, preferably 0.1 % by weight or less.

Next, the reaction between an iodized aromatic compound and hydroxy ion is described in detail by referring to an example of the process for producing p-aminophenol by the reaction between PIA and a hydroxy compound.

Other than the reactions between an iodized aromatic compound and a nucleophilic compound as described above, an aromatic compound can be produced similarly according to a suitable reaction.

Now, an example of the process of the present invention for producing PPD from PIA is assumed and explained by referring to the flow sheet shown in the drawing. The starting material AN is fed through the conduit 1 into an anolyte tank 2. The recovered sodium iodide concentrated in the distillation column 24 and the AN recovered in the distillation column 19 are circulated. The anolyte is circulated into the electrolytic cell 3 partitioned with a cation exchange membrane.

Catholyte in a catholyte tank 4 is fed to the cathode chamber of the electrolytic cell 3. The catholyte is, for example, an aqueous sodium hydroxide solution. A part of the catholyte is delivered to the decanter 5 to separate an aqueous solution of sodium phosphate and sodium iodide which is the aqueous layer from the AN solution of PIA which is the organic layer. The aqueous layer is circulated to the anolyte tank 2. The organic layer is delivered via the conduit 6 to the amination reactor 7. The amination reaction mixture is prepared by feeding ammonia through the conduit 8 together with the ammonia recovered in the ammonia water distillation column 10, and further feeding the cuprous iodide catalyst recovered by separation in the filter 13 via the conduit 9.

On completion of the reaction, excessive ammonia is recovered via the ammonia water distillation column 10, followed by addition of the aqueous sodium hydroxide solution of the catholyte through the conduit 11 in excess of the equivalent amount to convert the ammonium iodide by-product in the amination reaction, simultaneously with recovery of the ammonia generated via the ammonia water distillation column 10. The ammonia water evaporated is subjected to separation of water in the ammonia water distillation column 10. The reaction mixture from which ammonia has been removed is delivered to the catalyst separation tank 12, and the dibutyl ether layer recovered in the decanter 14 is fed to and mixed with the reaction mixture to precipitate the copper catalyst. The copper catalyst precipitated is separated by the filter 13 and supplied for circulation.

The reaction mixture separated from the copper catalyst is delivered into the decanter 14, wherein the upper layer of the dibutyl ether layer and the lower layer of PPD, aqueous sodium iodide solution are separated. The aqueous solution of the lower layer is delivered via the conduit 16 to the extraction column 15. Into the extraction column is fed AN from the conduit 18 and the aqueous sodium hydroxide solution from the conduit 17, and AN solution of PPD is obtained from the top and an aqueous solution of sodium iodide and sodium hydroxide from the bottom. The AN solution of PPD obtained in the extraction column 15 is delivered to the AN distillation column 19, wherein AN is recovered and delivered to the o-phenylenediamine (hereinafter abbreviated as OPD) removing column 20.

From the conduit 21, for example, thiourea is fed to convert OPD to a high boiling product. The crude PPD having converted OPD is delivered to the distillation column 22 to remove low boiling impurities and then delivered to the distillation column 23 to give purified PPD. From the bottom of the distillation column, high boiling impurities are withdrawn. The aqueous solution obtained from the bottom of the extraction column is delivered to the distillation column 24, wherein excessive water is removed, the concentrated sodium iodide is circulated into the anolyte tank 2 and the water removed is circulated into the catholyte tank 4.

As described above, according to the present invention, by addition of an inorganic weak acid salt and/or medium acid salt, the pH change in the aqueous layer of the electrolyte and the voltage change can be suppressed to prevent lowering in current efficiency of the iodized aromatic compound, and yet the current efficiency can be enhanced. Also, by limiting the pH to a specific range, still improved effect can be obtained. By addition of an inorganic weak acid salt and/or medium acid salt, it is now possible to stably perform an electrolytic reaction for a long term to a great advantage in industrial practice. Besides, by addition of an inorganic acid salt and/or medium acid salt, the voltage can be lowered to improve power unit. By allowing the thus obtained iodized aromatic compound to react with a nucleophilic reagent, a corresponding aromatic compound can be produced with good yield. Further, in production of PPD, in recovering the iodide formed after the amination reaction to be circulated into the electroytic system, by suppressing the amount of the product PPD accompanied in small amount to suppress the concentration of PPD existing in the electrolyte at a specific level or lower, it has become possible to prevent worsening of the electrolytic reaction. This consideration is also applicable to the production of other aromatic compounds.)

With respect to the above points, the process of the present invention is a very excellent industrial process for production of aromatic compounds.

The present invention is described in more detail by referring to the following Examples. The values measured in the Examples and Comparative Examples are obtained from the methods set forth below:

$$\text{Current efficiency (\%)} = \frac{\text{Mols of } PIA \text{ formed} \times 2}{\text{Quantity of current passed (Faraday units)}} \times 100$$

p/o (molar ratio)=PIA formed/OIA formed

Also, (%) in Examples and Comparative Examples is all % by weight except for current efficiency, recovery, conversion and selectivity.

EXAMPLE 1

An anolyte mixture of 75 g of sodium dihydrogen phosphate, 75 g of disodium hydrogen phosphate, 150 g of sodium iodide, 300 g of aniline and 1200 g of water is charged into an anolyte tank. 1 kg of an aqueous 5 % sodium hydroxide solution is charged into a catholyte tank. The electrolytes in both tanks are circulated to the following electrolytic cell.

The electrolytic cell consists of an anode chamber and a cathode chamber partitioned with a diaphragm, employing a titanium plate platinum anode and an iron plate cathode, both electrodes having a current passage area of 1 cm×100 cm, two sheets of polyethylene plates with a thickness of 2 mm having openings so that the current passage may be 1 cm×100 cm being placed between the both electrodes, and a perfluorocarboxylic acid cation exchange membrane being placed between the both plates to thereby form the cathode chamber and the anode chamber. The electrolytic cell has a feeding inlet and an outlet for the electrolyte, the electrolyte is passed at a velocity of 2 m/sec. and electrolysis is conducted at a current density of 10 A/dm$^2$ and at an electrolytic temperature of 50°0 C. for 2 hours. The pH of the aqueous layer in the anolyte is controlled previously at 6.5 and is maintained at pH 6.5 during electrolysis by addition of NaOH.

The average voltage is 3.5 V. After electrolysis, PIA in the electrolyte is analyzed by gas chromatography. As a result, the current efficiency is found to be 94 %. The pH change during electrolysis is small and the pH can be controlled easily. The p/o ratio of the iodoaniline formed is found to be 24.

Into a 500 ml autoclave are charged a mixture of 30 g of PIA and 35 g of ASN, 7.2 g of water, 3.5 g of cuprous iodide and 65 g of ammonia. The reaction is carried out at 75° C. for 5 hours at a pressure of 25 kg/cm$^2$. After completion of the reaction, excessive ammonia is liberated to obtain the reaction mixture. PPD is found to be formed in an amount of 14 g. To the reaction mixture is added 49 g of an aqueous 15 % sodium hydroxide solution, followed by heating under reduced pressure at 80° C. to remove ammonia by distilling out 15 g of ammonia water. The pH in the aqueous layer is found to be 13.1. Since sodium hydroxide remains, 35 g of dibutylether is added and the mixture is stirred, followed by filtration of the precipitate to recover 5.5 g of the copper catalyst. The filtrate is separated into two layers. The upper layer consists mainly of dibutylether, containing 1 % of PPD and 10 ppm of copper. The lower layer consists mainly of AN, water and sodium iodide, containing 15 % of PPD. The copper concentration is found to be 20 ppm. The lower layer weighed 80 g and is extracted four times with 20 g of aniline. In the aniline layer, 99 % of PPD is extracted. The aniline solution is distilled in vacuo to give 12.6 g of PPD.

COMPARATIVE EXAMPLE 1

Electrolysis is performed under the same conditions as in Example 1 except for removing sodium phosphate from the anolyte composition of Example 1. The voltage is found to be unstable with slight fluctuation from 4.1 to 4.5 V. The current efficiency is 86%. The pH during running can be controlled with difficulty, with pH changing from 7.5 to 5.1. The p/o ratio of the iodoaniline formed is 23.5.After completion of the reaction, the catholyte is observed and it is found that the organic layer is separated in a small amount, although no such separation is observed in Example 1.

EXAMPLE 2

Using the same electrolyte and electrolytic cell as in Example 1, electrolysis is carried out at a flow velocity of electrolyte of 2 m/sec., an electrolytis temperature of 50° C. and a current density of 10 A/dm$^2$ by varying the pH of the aqueous layer. The results are shown in Table 1.

TABLE 1

| | | | | |
|---|---|---|---|---|
| pH | 7.6 | 6.9 | 5.5 | 5.1 |
| Current efficiency (%) | 71*2 | 92 | 93 | Discontinued*1 |

*1At pH 5.1, the organic layer becomes liquid and adheres on the tank wall, etc. and cannot sufficiently be delivered into the electroly-cell, and therefore electrolysis is discontinued.

*2At pH 7.6, as the result of gas chromatographic analysis, 4-aminodiphenylamine and azobenzene are detected.

COMPARATIVE EXAMPLE 2

Using the same electrolytes, the electrolytic cell and also the electrolytic conditions as in Comparative example 1 except for varying the pH, electrolysis is carried out for 2 hours. The results are shown in Table 2.

TABLE 2

| | | | | |
|---|---|---|---|---|
| pH | 7.8 | 6.9 | 5.0 | 4.6 |
| Current efficiency (%) | 60 | 87 | 86 | 83 |

At pH 5.0 and 4.6, the organic layer is liquid without precipitation. However, at pH=4.6, the amount of the organic layer becomes very small. Perhaps, the aniline salt has been dissolved in the aqueous layer. At pH 7.8, as the result of gas chromatographic analysis, 4-aminodiphenylamine and azobenene are detected. After the reaction, the catholyte is observed to find that separation of the organic layer is increased at pH 5.0 and 4.6.

Example 3

As the electrolyte, a mixture of 70 g of potassium dihydrogen phosphate, 70 g of dipotassium hydrogen phosphate, 150 g of potassium iodide, 250 g of aniline and 1210 g of water is charged into an electrolyte tank. The pH of the aqueous layer is 6.0.

The electrolytic cell has an anode formed of a titanium plate having formed an oxide alloy by mixing platinum and titanium, coating and calcination and an iron plate as the cathode, both electrodes being separated by a polyethylene plate with a thickness of 2 mm having openings so that the current passage between the electrodes is 1 cm×100 cm thereby to form the electrolytic chambers. The electrolytic cell has an inlet and an outlet for the electrolyte. The electrolyte is passed at a velocity of 2 m/sec. and electrolysis is conducted at a current density of 10 A/dm$^2$ and at an electrolytic temperature of 50° C. for 2 hours. The pH of the aqueous layer in the anolyte is not controlled. The average voltage is 3.2 V. After electrolysis, PIA in the electrolyte is analyzed by gas chromatography. As a result, the current efficiency is found to be 92%. The p/o ratio of PIA formed is found to be 25.

COMPARATIVE EXAMPLE 3

Electrolysis is carried out for 2 hours in the same manner as in Example 3 except that the phosphoric acid salt is removed and water is increased to 140 g in the electrolyte composition of Example 3. During electrolysis, no pH control is performed. The pH is elevated from 6.0 to 11.3. The average voltage is 4.4 V and the current efficiency 32%.

EXAMPLES 4, 5, 6, 7 AND COMPARATIVE EXAMPLE 4

Electrolysis is carried out for 2 hours in the same manner as in Example 1 except that 0.1%, 0.5% and 1% of PPD is added into the electrolyte composition and the diaphragm in the electrolytic cell of Example 1 is changed to a cation exchange membrane obtained by sulfonation of a styrene-divinylbenzene copolymer reinforced with a glass fiber core material. The results are shown in Table 3.

TABLE 3

| | Example | | | | Comparative |
|---|---|---|---|---|---|
| | 4 | 5 | 6 | 7 | Example 4 |
| PPD conc. (%) | 0 | 0.1 | 0.2 | 0.5 | 1.8 |
| Current efficiency (%) | 93 | 85 | 80 | 71 | 53 |
| Presence of adherent on electrode surface | none | none | none | none | do, with increase of vol- |

TABLE 3-continued

| | Example | | | | Comparative |
|---|---|---|---|---|---|
| | 4 | 5 | 6 | 7 | Example 4 |
| | | | | | tage |

EXAMPLE 8

In Example 1, PIA is aminated, and, after removal of the copper catalyst, the two layers are separated from each other. 18 g of sodium iodide and 0.21 g of PPD are present in 75 g of the lower layer obtained by extraction of PPD in the lower layer with AN, . This reaction is repeated 10 times to obtain 760 g of recovered aqueous sodium iodide solutions with similar compositions. By use of 630 g of this solution, 75 g of sodium dihydrogen phosphate, 75 g of disodium hydrogen phosphate, 720 g of water and 300 g of aniline are added thereto to prepare an anolyte. Following otherwise the same electrolytic conditions as in Example 1, electrolysis is conducted in the same manner as in Example 1 for 2 hours. The aqueous layer of the electrolyte is maintained at pH 6.5. The voltage is 3.6 V. The current efficiency of PIA produced is found to be 89%.

EXAMPLE 9

In the same manner as Example 1, a mixture of 80 g of PIA obtained by electrolytic reaction and 120 g of aniline, and 40 g of water, 200 g of ammonia and 6.4 g of cuprous iodide are charged into an autoclave, and the reaction is carried out at 100°0 C. for 3 hours. After the reaction, excessive ammonia is liberated, and it is determined that 38 g of PPD is produced. With addition of 100 g of aqueous 15% sodium hydroxide, the mixture is heated to 80° C. under reduced pressure to evaporate 60 g of water simultaneously with removal of ammonia. The pH of the aqueous layer is measured to be 12.9 and sodium hydroxide is found to remain. Then, 160 g of diisopropyl ether is added and mixed, followed by filtration of the precipitated copper catalyst under reduced pressure, to recover 10.1 g of the copper catalyst. The filtrate is subjected to separation into two layers, of which the upper layer consists mainly of diisopropyl ether containing 10 ppm of copper, and the lower layer consists mainly of aniline and sodium iodide containing 36.5 g of PPD, with the copper concentration being 20 ppm. The lower layer is 260 g. The lower layer is extracted four times with 40 g of aniline. In the aniline layer, 92% of PPD is found to be extracted. Vacuum distillation of the aniline solution gives 31 g of PPD. After extraction with aniline, 250 g of the aqueous layer is obtained which contains 50 g of sodium iodide and 2.9 g of PPD.

EXAMPLE 10

The reaction of Example 9 is repeated three times to recover 760 g of an aqueous sodium iodide solution which contains 150 g of sodium iodide and 5.8 g of PPD. To the recovered soution are added 75 g of sodium dihydrogen phosphate, 75 g of disodium hydrogen phosphate, 590 g of water and 300 g of aniline to prepare an anolyte. Following otherwise the same conditions, electrolysis is conducted in the same manner as in Example 1. However, a perfluorosulfonic acid type cation exchange membrane is used as the diaphragm. Electrolysis is performed for 2 hours while maintaining the pH at 6.3. The voltage is 3.6 v. The current efficiency of PIA is found to be 78%.

EXAMPLE 11

The reaction is carried out by use of 5.1 g of the catalyst recovered in Example 9. Into a 500 ml autoclave are charged a mixture of 29 g of PIA obtained by the electrolytic reaction and 40 g of AN, and 8 g of water, 55 g of ammonia and the recovered catalyst obtained in Example 9, and the reaction is carried out at 90° C. for 6 hours. The pressure is 27 kg/cm$^2$-G. After completion of the reaction, excessive ammonia is liberated. In the residual mixture, 13.5 g of PPD is found to be formed. The conversion of PIA is 100%. Then, the mixture is treated similarly as in Example 1 with 40 g of 15% NaOH and 36 g of dibutyl ether to recover 5.0 g of the copper catalyst. The upper layer and the lower layer separated are found to contain copper at 15 ppm and 25 ppm, respectively. In the copper catalyst, the recovery of copper is found to be 98%.

EXAMPLE 12

The reaction is carried out similarly as in Example 1 and, after the amination reaction, excessive ammonia is removed to obtain 75 g of the residual mixture. 14.2 g of PPD is found to be produced. The conversion of PIA is 100%. To the residual mixture is added 60 g of water, followed by stirring to precipitate most of the copper catalyst, and 5.0 g of the copper catalyst is recovered by vacuum filtration. After filtration, the filtrate is separated into two layers, of which the upper layer (40 g) contains 3000 ppm of copper and 7% of ammonium iodide and the lower layer (95 g) contains 180 ppm of copper and 18.1% of ammonium iodide. Also, 7.0 g of PPD is present in the lower layer which is extracted with 35 g of aniline to extract 95% of the PPD. The aniline extracted and the above upper layer are mixed, and extracted with 40 g of water to obtain 98% ammonium iodide. The aniline solution of PPD thus obtained is found to contain 2000 ppm of copper. Into the solution are added simultaneously 50 g of 15% sodium hydroxide and 70 g of dibutyl ether to precipitate the copper catalyst, followed by filtration to recover 0.5 g of the copper catalyst. Subsequently, by separation into two layers, an upper organic layer consisting mainly of dibutyl ether with a copper content of 20 ppm and a lower layer consisting mainly of an aqueous sodium hydroxide solution with a copper content of 15 ppm containing 11 g PPD are obtained. The lower layer is extracted with 60 g of aniline to recover 11.5 g of PPD. Ditillation of this aniline solution gives 10.3 g of PPD. The recovery of copper in the copper catalyst is 97%.

EXAMPLE 13

Electrolytic reaction is carried out in the same manner as in Example 1. Then, the electrolyte is separated into an oily and an aqueous layer, from which the oily layer is isolated. Aniline is removed from the oily layer by distillation under reduced pressure to increase the PIA concentration to 90% by weight. Into a 500 ml small autoclave are charged 28.5 of this solution (0.115 mol as PIA), 10.0 g (0.205 mol) of sodium cyanide, 1.0 g (0.01 mol) of cuprous cyanide and 250 g of dimethylformamide, the autoclave is replaced internally with nitrogen and the mixture is stirred at 150° C. for 10 hours. After completion of the reaction, the reaction mixture is analyzed quantitatively to find that the conversion of PIA is 80% and the selectivity of PABN 98%.

EXAMPLE 14

In the same manner as Exampe 13, a concentrated aniline solution of PIA is removed from the electrolyte. Into a 500 ml small autoclave are charged 28.5 g (0.115 mol as PIA), 10.0 g (0.15 mol) of potassium cyanide, 2.0 g (0.010 mol) of cuprous cyanide and 250 g of dimethyl sulfoxide, followed by replacement of the inner atmosphere in the autoclave with nitrogen, and the mixture is stirred at 180° C. for 6 hours. After completion of the reaction, the reaction mixture is analyzed quantitatively to find that the conversion of PIA is 100% and the selectivity of PABN is 99%.

EXAMPLE 15

Electrolysis is carried out in the same manner as Example 3 and then the electrolyte is separated into oily and aqueous layers, from which the oily layer is separated. Into a 500 ml small autoclave are charged 250 g of the oily layer, 11.0 g (0.165 mol) of potassium cyanide and 1.0 g (0.010 mol) of cuprous cyanide, followed by replacement of the inner atmosphere in the autoclave with nitrogen, and the mixture is stirred at 180° C. for 12 hours. After completion of the reaction, the reaction mixture is analyzed quantitatively by gas chromatography to find that the conversion of PIA is 75% and the selectivity of PABN 95%.

EXAMPLE 16

In the same manner as Example 1, PIA is synthesized, and then PABN is synthesized in the same manner as Example 13. After completion of the reaction, 250 g of aniline and 500 g of water are added into the reaction mixture and crystals are filtered, followed by separation of the filtrate into oily and aqueous layers. The operation of adding 100 g of aniline into the aqueous layer for extraction of organics from the aqueous layer is repeated 5 times, and thereafter the aqueous layer is separated.

Next, the aqueous layer separated is mixed with 75 g of sodium dihydrogen phosphate, 75 g of disodium hydrogen phosphate, 125 g of sodium iodide, 300 g of aniline and 800 g of water to prepare an anolyte. Except for preparation of the anolyte, electrolysis is carried out in entirely the same manner as in Example 1. The average voltage is 3.5 V, the current efficiency of PIA produced is 89%. The p/o ratio of the iodoaniline formed is 25. Next, the electrolyte is separated into oily and aqueous layers, from which the oily layer is isolated. By use of the oily layer, PABN is synthesized in the same manner as in Example 13. The conversion of PIA is found to be 100% and the selectivity of PABN 98%.

EXAMPLE 17

Electrolytic reaction is carried out in the same manner as Example 1, and then the electrolyte is separated into oily and aqueous layers, from which the oily layer is isolated. From the oily layer, aniline is removed by vacuum distillation and the residue is concentrated to 90% by weight of the PIA concentration.

Next, 3.2 g (0.03 mol) of m-aminophenol, 2.0 g (0.03 mol) of potassium hydroxide, 10 g of dimethyl sulfoxide and 10 g of toluene are charged into a 100 ml four-necked flask, and the mixture is stirred under nitrogen gas stream at 130° C. for 3 hours, while permitting toluene to flow out. The reaction mixture is cooled to 100° C., and 0.4 g of copper iodide and 4.6 g (0.02 mol as PIA) of the concentrate of the oily layer obtained in electrolysis and 10 g of dimethyl sulfoxide are added into the four-necked flask, followed by stirring under a nitrogen gas stream at 100° C. for 3 hours. After completion of the reaction, the reaction mixture is analyzed by liquid chromatograhy to find that the yield of 3,4'-DADPE is 50% based on PIA.

EXAMPLE 18

Into a 100 ml four-necked flask are charged 3.2 g (0.03 mol) of m-aminophenol, 1.2 g (0.03 mol) of sodium hydroxide, 10 g of monochlorobenzene, and the mixture is stirred under a nitrogen gas stream at 150° C. for 3 hours while permitting monochlorobenzene to flow out. The reaction mixture is cooled to 100°0 C., and 0.4 g of cuprous iodide and 4.6 g (0.02 mol as PIA) of the concentrate of the oily layer obtained in electrolysis and 10 g of dimethyl sulfoxide are added into the four-necked flask, followed by stirring under a nitrogen gas stream at 100° C. for 3 hours. After completion of the reaction, the reaction mixture is analyzed by liquid chromatograhy to find that the yield of 3,4'-DADPE is 30% based on PIA.

EXAMPLE 19

The reaction is carried out in entirely the same manner as in Example 17 except for replacing m-aminophenol in Example 17 with p-aminophenol. The yield of 4,4'-DADPE is found to be 35%.

EXAMPLE 20

The reaction is carried out in entirely the same manner as in Example 18 except for replacing m-aminophenol in Example 18 with p-aminophenol. The yield of 4,4'-DADPE found to be 20%.

COMPARATIVE EXAMPLE 5

The reaction is carried out in entirely the same manner as in Example 17 except for replacing m-aminophenol in Example 17 with p-aminophenol, and p-iodoaniline with p-chloroaniline. The yield of 4,4'-DADPE is found to be 2%.

EXAMPLE 21

An electrolytic reaction is carried out in the same manner as in Example 1. Then, the electrolyte is separated into an oily and an aqueous layer, from which the oily layer is isolated. From the oily layer, aniline is removed by distillation under reduced pressure to increase the PIA concentration to 90% by weight.

Into a 100 ml microautoclave are charged 33 g (0.013 mol as PIA) of this concentrate, 4.0 g of potassium hydroxide, 20 g of water and 0.5 g (0.0035 mol) of cuprous oxide, and the the mixture is stirred at 120° C. for 6 hours. After completion of the reaction, phosphoric acid is added to adjust the pH of the aqueous layer to 7, followed by extraction with aniline. GC analysis of the aniline layer indicates that the converion os PIA is 95% and the selectivity to p-aminophenol is 60%.

EXAMPLE 22

Electrolytic reaction is carried out in the same manner as Example 21, and the oily layer is concentrated to a PIA concentration of 50% by weight.

Into a 100 ml microautoclave are charged 10 g (0.0228 mol as PIA) of this concentrate, 3.0 g of potassium hydroxide, 20 g of water and 0.20 g (0.0014 mol) of cuprous oxide, and the mixture is stirred at 120° C. for 10 hours. After completion of the reaction, the same treatment as in Example 21 is conducted and GC analysis gives the results that the converion of PIA is 40% and the selectivity to p-aminophenol is 85%.

EXAMPLE 23

As the electrolyte, a mixture of 70 g of potassium dihydrogen phosphate, 70 g of dipotassium hydrogen phosphate, 300 g of potassium iodide and 1200 g of water is used. The electrolytic cell used consists of a titanium plate having formed an oxide alloy by mixing platinum and titanium, coating and calcination as the anode and an iron plate as the cathode, both electrodes being partitioned with a polyethylene plate with a thickness of 2 mm having openings so that the current passage area may be 1 cm×100 cm placed therebetween thereby to form the electrolytic chambers. The electrolytic cell has an inlet and an outlet for the electrolyte, the electrolyte is passed at a velocity of 2 m/sec. and electrolysis is conducted at a current density of 10 A/dm$^2$ and at an electrolytic temperature of 50 ° C. for one hour. The average voltage is 3.2 V. The pH in the electrolyte changes from 6.5 to 7.5. The electrolyte is taken out, 53 g of phenol is added thereto and the mixture stirred at 30° C. for 30 minutes. After completion of the reaction, 50 g of phosphoric acid and 500 g of benzen are charged into the reaction mixture to extract the product into the benzene layer. GC analysis of the benzene layer shows production of p-iodophenol, o-iodophenol and 2,4-diiodophenol. The yields based on the current quantity passed in the electrolysis are 57% for p-iodophenol, 32% for o-iodophenol and 2% for 2,4-diiodophenol, respectively.

After evaporation of benzene from the reaction mixture, the mixture containing iodophenol from which benzene is removed, 80 g of ammonia, 7 g of cuprous iodide and 8 g of water are charged, and the reaction is carried out at 100° C. for 8 hours at a pressure of 30 kg/cm$^2$. After completion of the reaction, excessive ammonia is liberated to obtain a reaction mixture. GC analysis of the reaction mixture shows production of 96% of p-aminopheol and 94% of o-aminophenol, based on p-iodophenol and o-iodophenol, respectively.

COMPARATIVE EXAMPLE 6

Electrolytic reaction and the reaction with phenol are carried out in entirely the same manner as Example 23 except for changing 70 g of potassium dihydrogen phosphate in Example 23 to 140 g and 70 g of dipotassium hydrogen phosphate to 0 g. The pH of the electrolyte changes from 4.9 to 6.0. The reaction with phenol does not proceed at all by merely stirring the mixture under room temperature for 15 minutes, but p-iodophenol and o-iodophenol are found to be formed slightly when stirred at 50° C. for 5 hours.

COMPARATIVE EXAMPLE 7

Electrolytic reaction and the reaction with phenol are carried out in entirely the same manner as in Example 23 except for changing 70 g of potassium dihydrogen phosphate in Example 23 to 0 g and 70 g of dipotassium hydrogen phosphate to 35 g. The pH of the electrolyte is changes from 11.1 to 11.6. After completion of the reaction with phenol, 100 g of phosphoric acid and 500 g of benzene are added into the reaction mixture to extract the product into the benzene layer. Analysis of the benzene layer indicates that the yields based on the current quantity passed in electrolysis are 26% for p-iodophenol, 11% for o-iodophenol and 19% for 2,4-diiodophenol.

EXAMPLE 24

Electrolysis is conducted in entirely the same manner as Example 23 except for using a mixture of 25 g of sodium dihydrogen phosphate, 75 g of disodium hydrogen phosphate, 300 g of sodium iodide and 1200 g of water as the electrolyte. The average voltage is 3.1 V. The pH of the electrolyte changes from 8.1 to 9.0. This electrolyte is taken out, 60 g of anisole is added thereto and the mixture is stirred at 80° C. for 15 hours. After completion of the reaction, unaltered iodine is treated with an aqueous sodium thiosulfate solution and the reaction mixture is extracted with 500 g of benzene. GC analysis of the benzene layer shows formation only of p iodoanisole. No o-isomer is found to be formed. The yield based on the current quantity passed in electrolysis is found to be 26%. The reaction mixture is allowed to react with ammonia in entirely the same manner as in Example 23. The yield of p-aminoanisole is found to be 94% based on p-iodoanisole.

COMPARATIVE EXAMPLE 8

In Example 24, 25 g of sodium dihydrogen phosphate is changed to 150 g and 75 g of disodium hydrogen phosphate is changed to 0 g. Following otherwise entirely the same procedure as in Example 24, electrolytic reaction is carried out, and similarly the reaction with anisole is carried out. GC analysis after completion of the reaction detects no formation of the iodide of anisole.

COMPARATIVE EXAMPLE 9

In Example 24, 100 g of sodium hydroxide is added in place of adding sodium dihydrogen phosphate and disodium hydrogen phosphate. Following otherwise entirely the same procedure as in Example 24, electrolytic reaction is carried out, and similarly the reaction with anisole is carried out. After completion of the reaction, phosphoric acid is added into the reaction mixture for neutralization, followed by extraction with benzene. GC analysis of the benzene detects no formation of the iodide of anisole.

What we claim is:

1. A process for producing a nucleophile-substituted aromatic compound comprising the steps of:

oxidizing an iodide compound by electrolytic oxidation in an electrolyte comprising an inorganic acid salt selected from an inorganic weak acid salt, an inorganic medium acid salt or a mixture thereof to form an electrolyzed product; reacting the electrolyzed product with an aromatic compound having an electron donating group with a Hammet's substituent constant (6p) of −0.25 or lower to produce an iodized aromatic compound substituted with said electron donating group; and reacting the iodized aromatic compound with a nucleophilic reagent selected from ammonia, aminophenol, a cyano compound, a hydroxyl compound or a fluoro compound to form said nucleophile-substituted aromatic compound.

2. The process according to claim 1, wherein the inorganic acid salt is a phosphoric acid salt.

3. The process according to claim 2, wherein the phosphoric acid salt is ammonium phosphate, sodium phosphate or potassium phosphate.

4. The process according to claim 1, wherein iodide compound is ammonium iodide, sodium iodide or potassium iodide.

5. The process according to claim 1, wherein the said electron donating group is an amino group, a N-alkylamino group, a N,N-dialkylamino group, a hydroxy group or an alkoxy group.

6. The process according to claim 1, wherein the said electron donating group is an amino group, a N-alkylamino group or a N,N-dialkylamino group, and the iodide compound is subjected to electrolytic oxidation while maintaining the pH of the aqueous layer of the electrolyte at 5.5 to 6.9.

7. The process according to claim 1, wherein the said electron donating group is a hydroxy group or an alkoxy group, and the iodide compound is subjected to electrolytic oxidation while maintaining the pH of the aqueous layer of the electrolyte at 6.5 to 10.

8. The process according to claim 1 or claim 6, wherein said aromatic compound having an electron donating group is aniline, said iodized aromatic compound is p-iodoaniline, the nucleophilic reagent is ammonia and the aromatic compound produced is p-phenylenediamine.

9. The process according to claim 8, wherein the reaction of said p-iodoaniline with said ammonia is conducted in the presence of a copper catalyst, water and aniline and, after completion of the reaction, ammonia is removed from the reaction mixture, followed by addition of an ether and an alkali hydroxide to recover the copper catalyst.

10. The process according to claim 9, wherein the copper catalyst is cuprous iodide.

11. The process according to claim 9, where said ether comprises 6 to 8 carbon atoms.

12. The process according to claim 8, wherein during the reaction between p-iodoaniline and ammonia an ammonium iodide by-product is formed, recovered and reacted with an alkali hydroxide to form an alkali iodide, which is circulated back in the electrolyte, while maintaining the concentration of p-phenylenediamine in the electrolyte at 0.5 wt. % or less.

13. The process according to claim 1, wherein the aromatic compound having an electron donating group is fed into the electrolyte, before or during the course of the electrolytic oxidation reaction.

14. The process according to claim 1, wherein the aromatic compound having an electron donating group is fed into the electrolyte after completion of the electrolytic oxidation reaction.

15. The process according to claim 9, wherein said ether and said alkali hydroxide are simultaneously added.

* * * * *